US010173216B2

(12) United States Patent
Ducree et al.

(10) Patent No.: US 10,173,216 B2
(45) Date of Patent: Jan. 8, 2019

(54) CENTRIFUGAL CAPTURE SYSTEM

(71) Applicant: Dublin City University, Dublin (IE)

(72) Inventors: Jens Ducree, Ashbourne (IE); Robert Burger, Schuttertal (DE)

(73) Assignee: DUBLIN CITY UNIVERSITY, Dublin (IE)

( * ) Notice: Subject to any disclaimer, the term of this patent is extended or adjusted under 35 U.S.C. 154(b) by 1132 days.

(21) Appl. No.: 14/335,683

(22) Filed: Jul. 18, 2014

(65) Prior Publication Data

US 2015/0018192 A1 Jan. 15, 2015

Related U.S. Application Data

(62) Division of application No. 12/855,579, filed on Aug. 12, 2010.

(51) Int. Cl.
*B01L 3/00* (2006.01)
*B04B 15/00* (2006.01)

(52) U.S. Cl.
CPC ..... *B01L 3/502753* (2013.01); *B04B 15/00* (2013.01); *B01L 2200/0668* (2013.01); *B01L 2300/0803* (2013.01); *B01L 2300/0861* (2013.01); *B01L 2400/0409* (2013.01); *B01L 2400/0677* (2013.01); *B01L 2400/0688* (2013.01); *B01L 2400/086* (2013.01)

(58) Field of Classification Search
None
See application file for complete search history.

(56) References Cited

U.S. PATENT DOCUMENTS

2001/0055812 A1 12/2001 Mian et al.
2002/0168663 A1 11/2002 Phan et al.
2003/0134416 A1* 7/2003 Yamanishi ..... A61M 1/36 435/372
2004/0264323 A1* 12/2004 Worthington .... C01N 35/00069 369/47.27
2007/0125942 A1* 6/2007 Kido ..... B01F 13/0059 250/284
2007/0224591 A1 9/2007 Gui et al.
2007/0259385 A1 11/2007 Rissin et al.
2009/0093374 A1 4/2009 Suh et al.
(Continued)

FOREIGN PATENT DOCUMENTS

WO WO 2007/024701 * 3/2007 ..... C12Q 1/68
WO 2008/091031 A1 7/2008

OTHER PUBLICATIONS

Kijanka (2009) Dossel and Schlegel (eds) IFMBE Proceedings 25/VIII p. 343-346 (Year: 2009).*
(Continued)

*Primary Examiner* — Melanie Yu Brown
*Assistant Examiner* — Richard Moerschell
(74) *Attorney, Agent, or Firm* — Cozen O'Connor

(57) ABSTRACT

A particle capture system that can be used in the context of a lab-on-a-chip platform for particle- and cell-based assays is described. The system comprises a capture chamber comprising a plurality of capture sites, the capture sites defining a capture area configured to receive individual particles travelling within the capture chamber. By rotating the chamber, the individual particles are biased towards the capture sites where they may be captured.

26 Claims, 12 Drawing Sheets

(56) References Cited

U.S. PATENT DOCUMENTS

2012/0040843 A1 2/2012 Ducree et al.

OTHER PUBLICATIONS

Di Carlo et al., "Dynamic single cell culture array," *Lab on a Chip* 6:1445-1449, 2006.
Ducree et al., "Centrifugal Capture System," Restriction Requirement dated Feb. 1, 2012, for U.S. Appl. No. 12/855,579, 13 pages.
Ducree et al., "Centrifugal Capture System," Response to Restriction Requirement filed Apr. 19, 2013, for U.S. Appl. No. 12/855,579, 4 pages.
Ducree et al., "Centrifugal Capture System," Office Action dated Jun. 20, 2013, for U.S. Appl. No. 12/855,579, 19 pages.
Ducree et al., "Centrifugal Capture System," Amendment filed Oct. 21, 2013, for U.S. Appl. No. 12/855,579, 16 pages.
Ducree et al., "Centrifugal Capture System," Office Action dated Feb. 18, 2014, for U.S. Appl. No. 12/855,579, 27 pages.
Kijanka et al., "Minimizing stress exposure to cells using novel microfluidic cell capture devices," *World Congress on Medical Physics and Biomedical Engineering*, IFMBE Proceedings, Munich, Germany, Sep. 7-12, 2009, vol. 25/8, 343-346, DOI:10.1007/978-3-642-03887-7 99.
Kim et al., "Cell research with physically modified microfluidic channels: A review," *Lab on a Chip* 8:1015-1023, 2008.
Lee et al., "Single-cell assay on CD-like lab chip using centrifugal massive single-cell trap," *Sensors and Actuators A* 143:64-69, 2008.

* cited by examiner

| | |
|---|---|
| Captured beads | 477 |
| Lost Beads | 87 |
| Capture efficiency | 85 % |

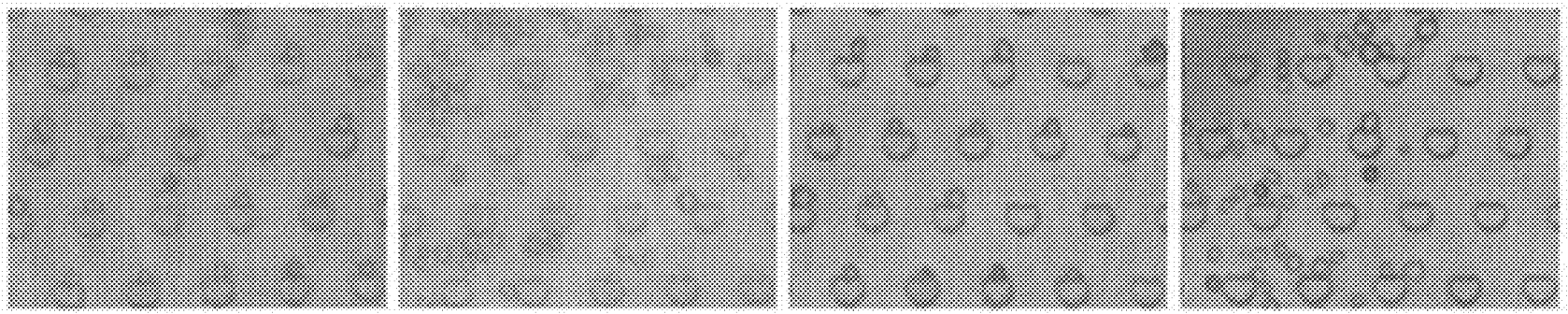
FIG. 13A
FIG. 13B
FIG. 13C
FIG. 13D
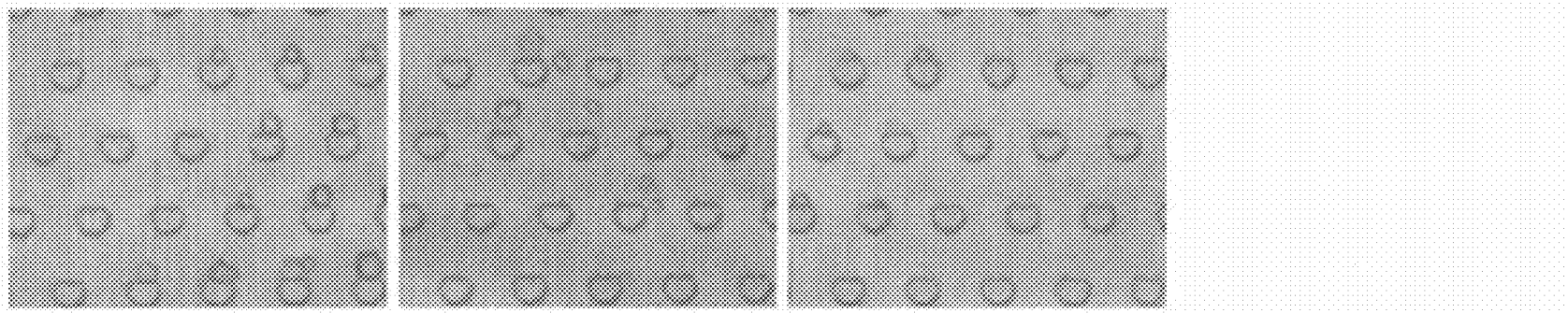
FIG. 13E
FIG. 13F
FIG. 13G

CENTRIFUGAL CAPTURE SYSTEM

BACKGROUND

Technical Field

The present application relates to a centrifugal capture system for use in capture of particles such as beads or cells, and more particularly relates to a system comprising a rotatable capture chamber comprising a plurality of capture sites. The capture sites are geometrically dimensioned to receive one or more particles which are biased to the capture sites through a rotation of the capture chamber.

Description of the Related Art

Microfluidic systems for capturing and manipulating small numbers of cells or even single cells are a field of growing interest. Applications include single cell culture and treatment for drug screening and cell fusion. Existing techniques use pressure driven systems in which the geometrical capture structures themselves lead to an induced non-axial component of the flow field leading to a significant decrease in capturing efficiency. There is therefore a need to provide an improved system.

BRIEF SUMMARY

These and other problems are addressed in accordance with the present teaching by a centrifugal capture system that is operable under stagnant flow conditions. In a first configuration the system comprises a capture chamber comprising a plurality of capture sites defined therein. The system is configured such that a fluid comprising particles of interest may be introduced into the capture chamber. In a first configuration, the system is operable under stagnant flow conditions such that while particles are being biased towards individual capture sites. This means that there is no flux of the fluid within the capture chamber during a rotation of the capture chamber. In another configuration, a flow within the chamber may be present, albeit exerting less impact on the particle trajectories than the effect of the centrifugal force that is biasing the particles towards the individual capture sites such that a combination of sedimentation and slow flow is also possible. A rotation of the capture chamber induces a centrifugal force which induces motion onto the particles such that they are biased in straight lines in a radial direction away from the axis of rotation of the chamber and are sedimented into the capture sites. It will be appreciated that the particles experience a force related to the Stokes drag which also affects their capture within the individual capture sites. A plurality of capture sites may be provided within the chamber, the capture sites being provided at different distances away from the axis of rotation. In a first configuration the capture sites are provided in an array of individual rows, each row being a defined distance from the axis of rotation. Individual rows may be staggered relative to one another.

BRIEF DESCRIPTION OF THE DRAWINGS

The present application will now be described with reference to the accompanying drawings in which:

FIGS. 13A-13G show sequential images taken through time delimited spinning and ultrasonic agitation of a capture chamber with the release of captured beads by repeated cycles of ultra-sonic treatment and spinning at 15 Hz, with FIG. 13A showing an array after trapping of beads, FIG. 13B showing the array after a first ultrasonic treatment; FIG. 13C showing the array after a second spinning cycle; FIG. 13D showing the array after a second ultrasonic treatment; FIG. 13E showing the array after a third spinning cycle; FIG. 13F showing the array after a third ultrasonic cycle; and FIG. 13G showing the array after a fourth spinning cycle where almost all beads have been recovered from the cups

DETAILED DESCRIPTION

The present teaching will now be described with reference to exemplary arrangements which will assist the person of skill in an understanding of the benefits and features of system incorporating the present teaching. By providing a system and methodology in accordance with the present teaching it is possible to provide a simple and highly efficient way to capture (typically micron-sized) particles, e.g. beads or biological cells or a combination of the two, on a centrifugal microfluidic platform in geometrical traps under stagnant or throttled flow conditions. In the exemplary arrangements which are described herein the dimensions of the capture sites are scale-matched with the dimensions of the particles being captured. The number of particles (between one and multiple) per capturing site can be set by the geometry and spatial alignment of the capturing elements. Scale matching between the capturing elements and the particles allows the capture down to one single bead or cell per site. The present teaching thus enables the investigation of single or small numbers of particles in an array format. High capture efficiencies as well as the capability to isolate defined numbers of particles down to a single-particle level are enabled by the interplay of stagnant or throttled flow conditions with micron-scale capture sites. In the same centrifugal setup, the captured particles may be exposed to a sequence of other liquids such as culture medium, wash buffers and drugs. The particles may also be exposed to other force fields which known from the state-of-the-art to have an effect on the particles, e.g. dielectrophoretic or magnetic or ultrasound. Also biochemical assays, particle counting and analysis/identification may be performed on the captured particles.

Figure 1:
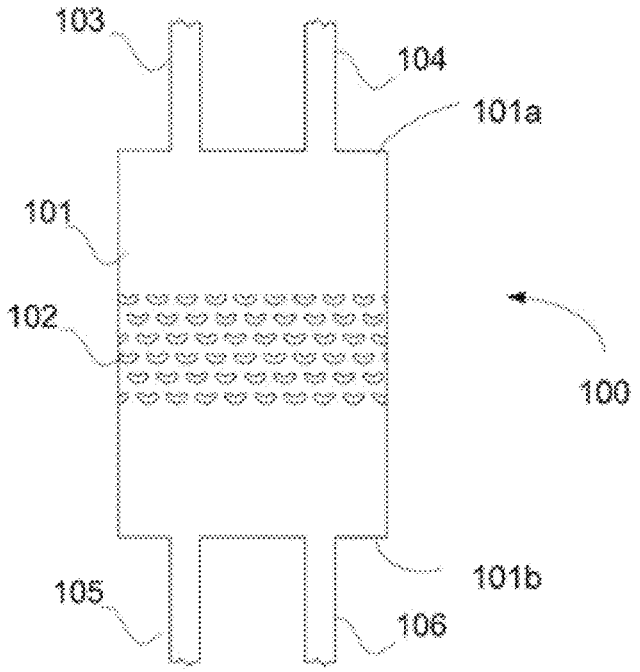
FIG. 1 is a schematic showing an exemplary capture chamber with a plurality of capture sites provided therein in accordance with the present teaching.

FIG. 1 shows a system 100 comprising a capture chamber (101) exhibiting an array of capture structures or capture sites (102), each of them featuring characteristic dimensions in the order of 1 to 1000 micrometers. In this exemplary non-limiting configuration the chamber has two inlets (103, 102) and two outlets (105,106), although it will be appreciated that these numbers could be modified depending on the application.

The capture chamber is defined within or provided on a rotatable substrate (121—see FIG. 8). The capture chamber has a first end (101*a*) defining a region that is proximal to the axis of rotation of the chamber and a second end (101*b*) defining a region that is distal to the axis of rotation of the chamber. The inlets are desirably provided adjacent to or in the proximal end (101*a*) and the outlets are desirably provided adjacent to the distal end (101*b*).

Figure 2:
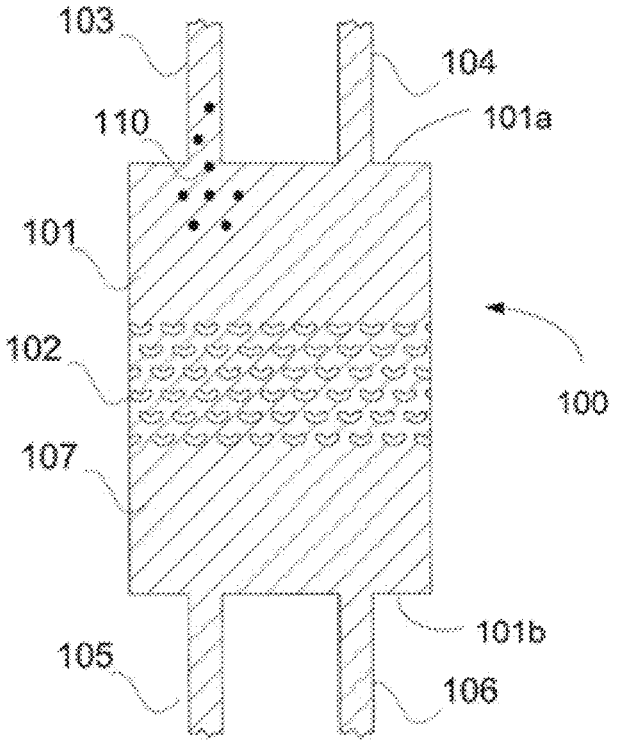
FIG. 2 shows the capture chamber of FIG. 1 with particles being introduced.

As shown in FIG. 2, in a first step the chamber (101) is filled with a liquid (107) having a lower density than the particles to be captured. The filling can either be performed under rotation of the capture chamber or while the motion is stopped. In a second step, the particle containing sample (110) is introduced into the chamber through the inlet(s) (103, 104). It will be appreciated that the first and second steps could be done concurrently, i.e. the liquid (107) and the particle containing sample (110) could be introduced into the capture chamber at the same time.

Figure 3:
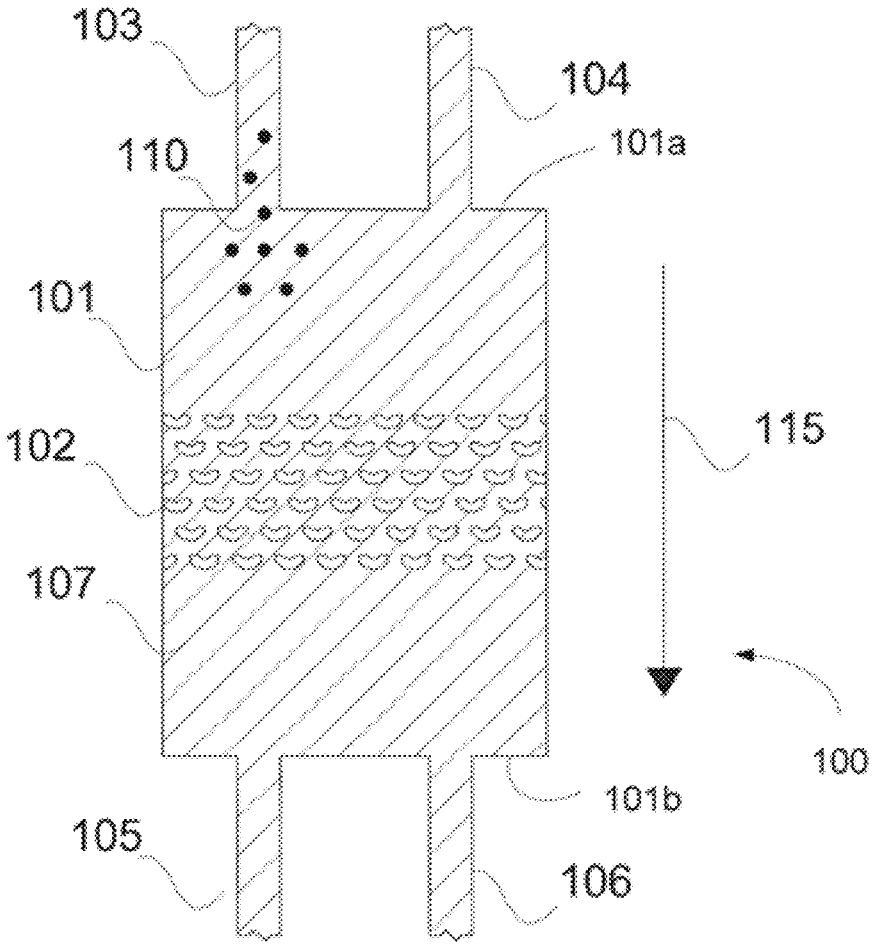
FIG. 3 shows the chamber of FIG. 2 under the influence of a centrifugal force such as provided by a rotation of the chamber.

In a third step shown in FIG. 3, the system is rotated (at typical frequencies in the range of 1 to 100 Hz, preferably 10 to 50 Hz). This frequency should be sufficient to induce sedimentation of the particles into the capture sites. Where stagnant flow conditions are employed, during the third step, the system is operated such that there is little or no flux of liquid through said chamber (101). During this third step, the particles are sedimented on straight lines in the radial direction away from the axis of rotation of the chamber, under the influence of the centrifugal force (115) and the Stokes drag. Before, during or after sedimentation, the particles may also be exposed to other forces such as magnetic fields, optical tweezers, dielectrophoresis or ultrasound.

Figure 4:
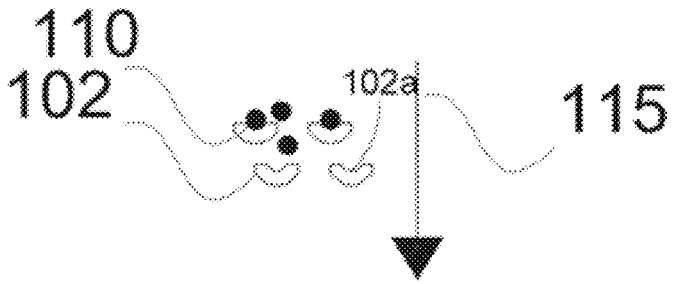
FIG. 4 shows details of capture of particles into capture sites in accordance with the present teaching.

As shown in FIG. 4, during the biasing of the particles by the centrifugal force (115), the particles come into contact with and become captured by the capture sites (102). The specifics of the geometry of the capture sites may vary. For example as shown in FIG. 4, each of the capture sites is dimensioned as a cup-like capturing element (102) defining a capture area (102*a*) that is proximal to the axis of rotation of the capture chamber. As shown in more detail in FIG. 6, the capture area (102*a*) is defined by side walls (102*b*) extending rearwardly away from the distal end (101*b*) of the capture chamber (101). The side walls (102*b*) define a curved or arcuate surface that presents a concave surface in the direction of the centrifugal force. This region between the individual side walls is the capture area, and, depending on the distances between the side walls, can be dimensioned for receipt of particles of specific size.

Another variant to the cup-like capturing elements is a capture site defined by a small depression extending perpendicular to the centrifugal field and parallel to gravity.

Figure 5:
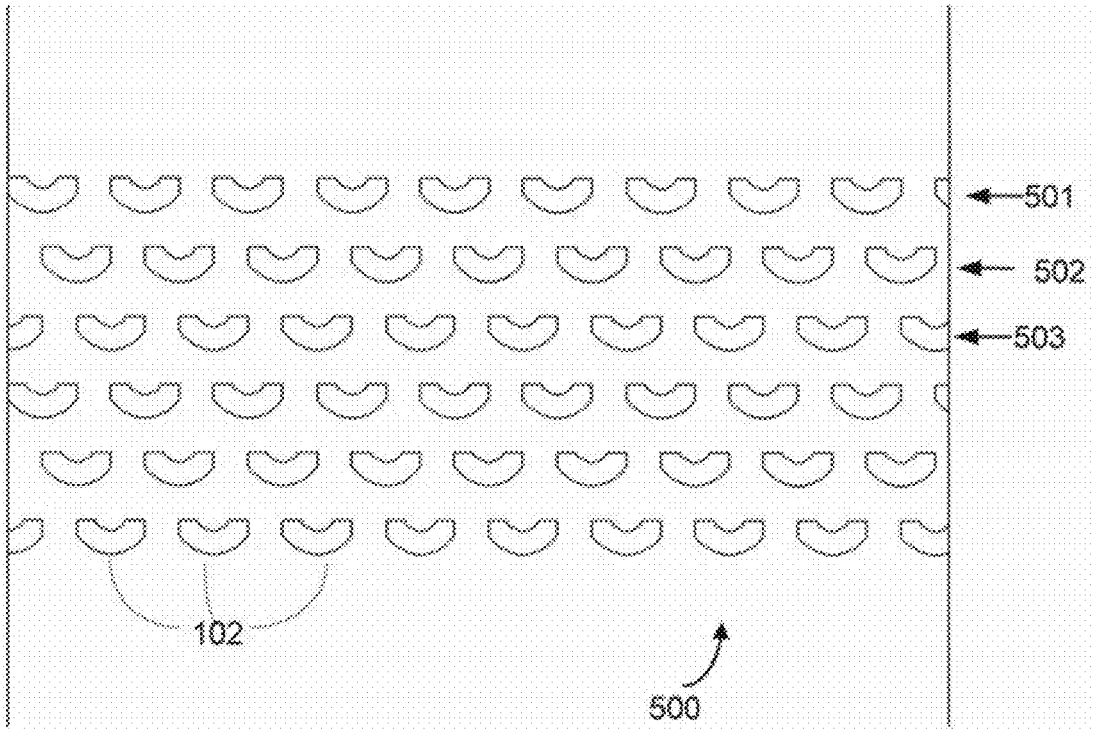
FIG. 5 shows in schematic form an array of capture sites in a plurality of staggered rows.

Each capturing element or capture site is designed such that it can retain a defined number of particles, at least one. Certain configurations may be dimensioned to allow not more than one particle to occupy the capture site. Once a capturing element is filled to maximum capacity, subsequently arriving particles will not be captured but propagate to the next capturing element (FIG. 4). To increase the capture efficiency, i.e. to achieve a high ratio of retained to the overall number of particles, several lines of capturing elements (102) are staggered in the radial direction, possibly in an interlaced fashion. In this way and as shown in FIG. 5, an array (500) of capture sites may be provided. The individual capture sites (101) may be arranged in rows (501, 502, 503), with each row differing in its location within the capture chamber to the other rows. By interlacing or staggering the individual rows there is no direct path in a straight line from the proximal end to the distal end of the chamber such that particles travelling under the influence of the centrifugal force will encounter a capture site during their path.

Initial experiments showed that >90% of all initially present particles can be captured with this system. Also capture elements designed to capture different numbers of particles can be aligned in the same array. It may also be possible to implement filtering on a polydisperse suspension of particles by size exclusion from small capture elements. The array itself can be of square, rectangular or any other shape including a spatially varying grid distance. In a fourth step, the captured particles can be examined or the environmental conditions can be influenced by changing the liquid in the camber or adding substances such as culture medium, wash, staining or elution buffers, and drugs, or combinations thereof.

Therefore it will be appreciated that in accordance with the present teaching that it is possible to easily split an initial sample consisting of a multitude of particles into spatially separated groups of particles, each consisting of a defined number of particles. A special application of this invention is the study of single cell behavior. In this case instead of particles, biological cells are used. Cells can be investigated by common means, such as optical instrumentation, e.g. microscopy, or by external or integrated sensors, e.g. based on impedance measurements. The grid or array can also be used to study inter-cell communication. Also a sequence or cell suspensions might be introduced to the array, e.g. to study the interaction of different cell types or between treated and untreated cells in a single capture element.

It will be appreciated that the present teaching employs a unique combination of centrifugal sedimentation, stagnant flow conditions and precisely fabricated microstructures. Microfabrication enables scale-matching such that defined numbers of (monodisperse) particles can be captured in each element. Centrifugal action allows propelling the particles under stagnant flow. The stagnant flow itself avoids that, as prescribed by the continuity of flow lines, non-radial velocity components arise in the vicinity of the capture elements which tend to carry the particles away. Nevertheless, the structure may also be operated in flow mode, e.g. during capture or exposure to fluids once captured. If desired, release of the cells may be enabled by gravitational or centrifugal sedimentation in the opposite direction, e.g. by orienting the chip correspondingly.

In modifications to that described heretofore, the present teaching advantageously provides for a varying of lateral spacing between capture sites within the same line, a varying of the number of capturing elements in different lines and/or vary the spacing between capturing lines.

Figure 6:
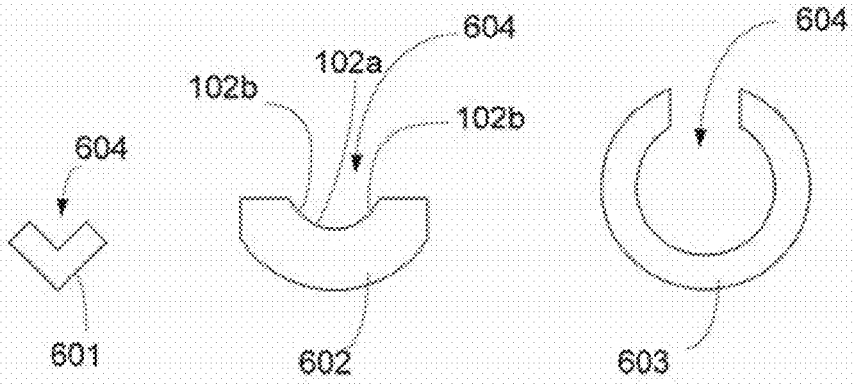
FIG. 6 shows examples of different geometrical configurations for use as capture sites in accordance with the present teaching.

In some setups it might be advantageous to vary the shape of the capturing elements. While it is not intended to limit the present teaching to any one specific geometrical configuration some possible shapes are shown in FIG. 6, which shows a V-shaped capture site (601), a cup-shaped capture site (602) and a collar or torc shaped capture site (603). It will be appreciated that each of these capture sites defines a capture area (604) that is open towards the proximal end of the chamber. One chamber can contain either only one type of capturing element or a multitude of different capturing elements.

Figure 7A:
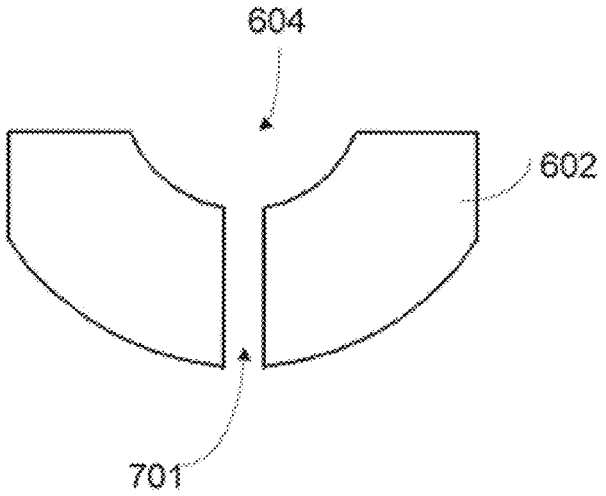
FIG. 7A shows a further example of a geometrical configuration for a capture site in accordance with the present teaching.

In some setups it might be advantageous to structure the capturing elements such that liquid can flow through the capturing elements by introducing sieving elements such as pores, slits, holes or the like within capturing structures and/or by creating a slit above or below the capturing element. FIG. 7A shows an example of providing a slit (701) in a mid-region of a cup-shaped capture site (602). The size of these openings should be dimensioned smaller than the particle that is intended to be trapped in the respective capturing element. However, it is possible to combine capturing elements with different sizes of the openings in the same chamber in order to spatially separate particles of different sizes.

Figure 7B:
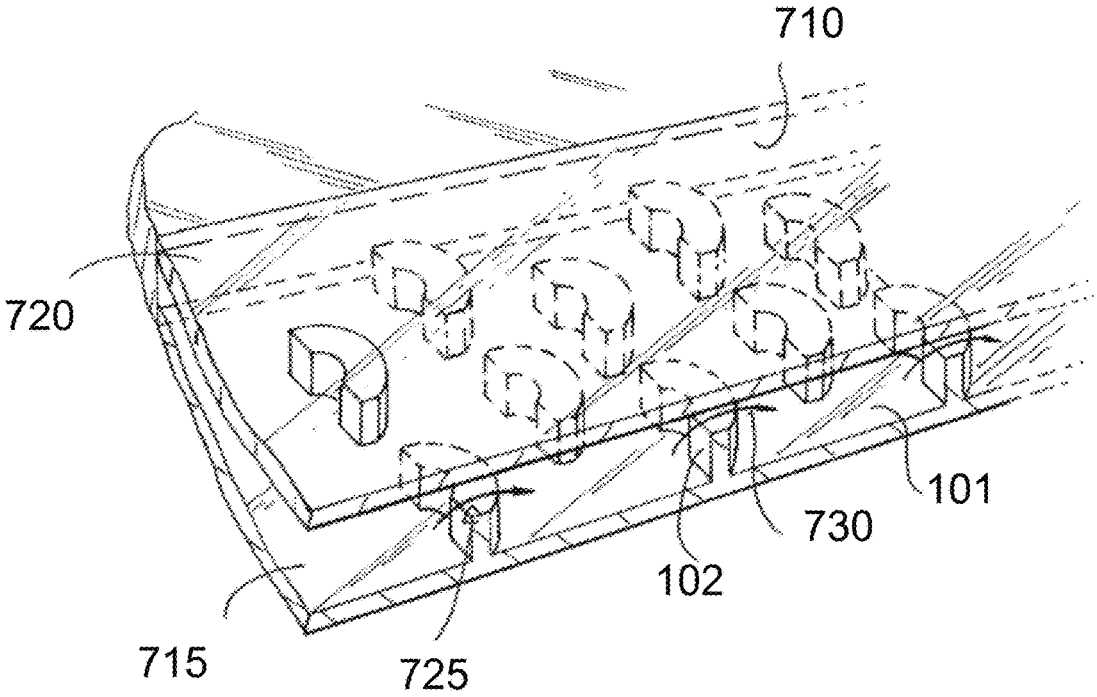
FIG. 7B shows in cut-away form a three dimensional representation of a capture chamber in accordance with the present teaching.

Another arrangement shown in FIG. 7B allows capture of particles while at the same time allow a movement of the fluid through the chamber by providing the capture sites 102 having a height less than side walls 710 of the chamber 101. It will be appreciated that the chamber 101 will typically define a fixed volume, the chamber having side walls 710, a base 715, and a roof 720. The capture sites are desirably formed as extending upwardly from the base 715 towards the roof 720 of the chamber. In certain configurations the capture sites may extend fully between the base and the roof. In other configurations such shown in FIG. 7B, the height of individual ones of the capture sites is less than the height of the side walls such that a gap 725 is defined between the top of the capture sites and the roof of the chamber. Where such a gap is defined a fluid may pass through that gap as shown in the directional arrow 730.

It may be desirable to concentrate the passage of the particles, e.g. through a mid-region of the chamber. This may be provided by providing baffles or guides—generically termed biasing means—to preferentially direct particles away from the side walls and towards that mid region. This may be provided to effect a lateral distribution of beads in a homogenous fashion across the chamber. In addition are as an alternative to the physical baffles, agitation in the inlet and the free sedimentation path prior to the capture region may be used to induce to a more homogeneous or more focused distribution of incoming particles prior to their exposure to individual capture sites.

The invention described above can easily be integrated in a more complex setup, where the inlet(s) of the capturing chamber is connected to one or more upstream structures, that perform for example tasks such as sample preparation. The outlet(s) of the chamber can for example be connected to a structure that performs a detection of certain biological markers, e.g. secreted from (stimulated) biological cells or eluted off the captured beads. Another variant to change between stagnant flow mode during capture and flow mode to expose the captured particle to a sequence of reagents is to close the chamber with a valving element, e.g. sacrificial valves opening upon exposure to radiation or heat. The valving might also be implemented by frequency-controlled valves such as a siphon primed by capillary action or overflow. Of course, other up and downstream process steps well documented in the literature of lab-on-a-chip or centrifugal "lab-on-a-disk" technologies can be imagined easily.

Figure 8A:
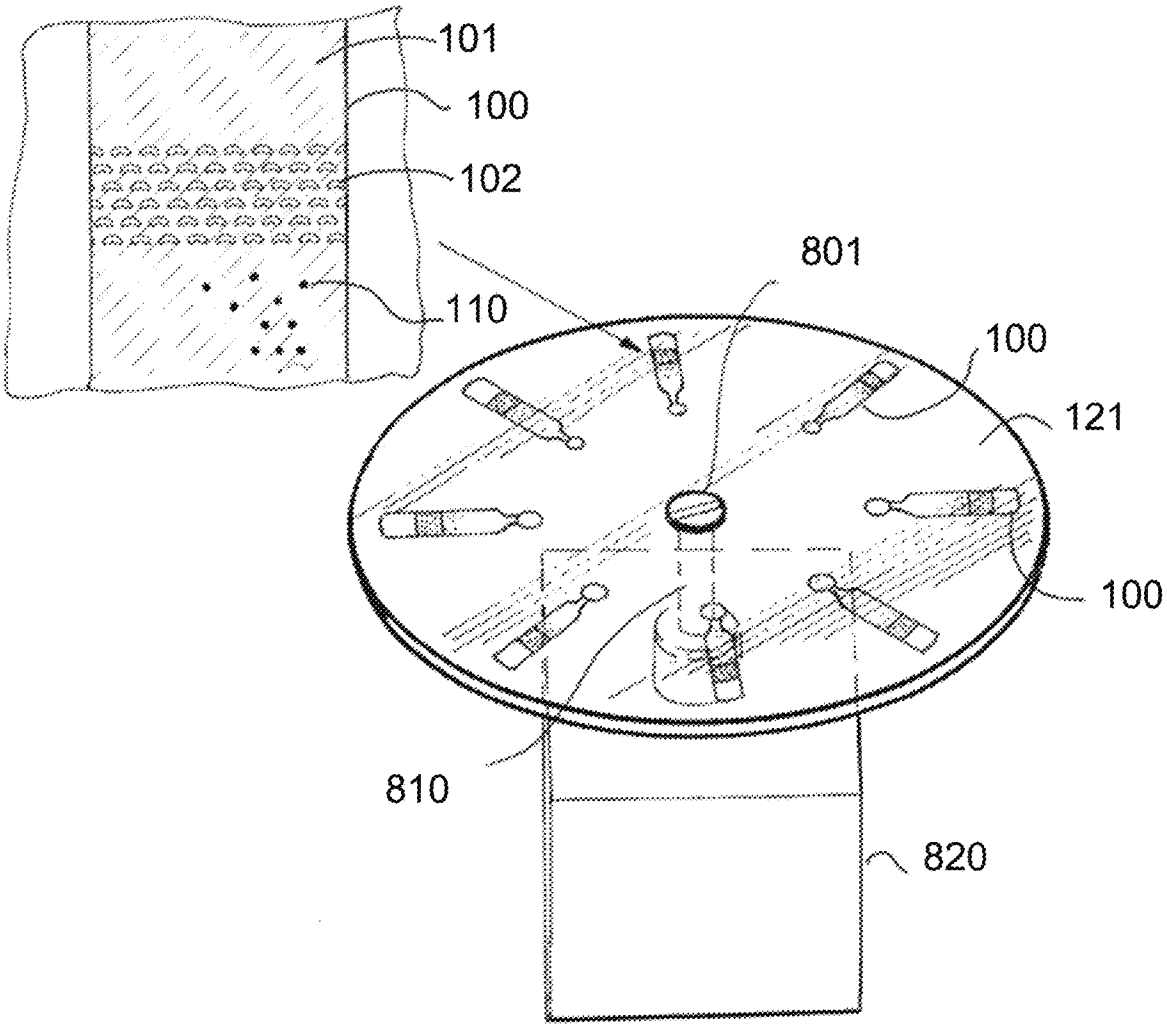
FIG. 8A shows in schematic form a disk having a capture chamber provided thereon, the disk being rotatable on a spindle, in accordance with the present teaching.

As was discussed above a system (100) in accordance with the present teaching may be integrated in a disk shaped substrate (121), an example being shown in FIG. 8A.

Such a disk may be considered as being similar to a compact disk having an aperture 801 for receiving the disk 121 onto the spindle 810 of a rotatable drive 820 which comprises a motor. The aperture 801 defines the axis of rotation of the disk. In the exemplary arrangement of FIG. 8A, a plurality of individual chambers 100 are provided, each at a specific location on the disk. These individual chambers may be provided of the same or different types and can be arranged about the surface of the disk allowing for a multiplex assay.

Figure 8B:
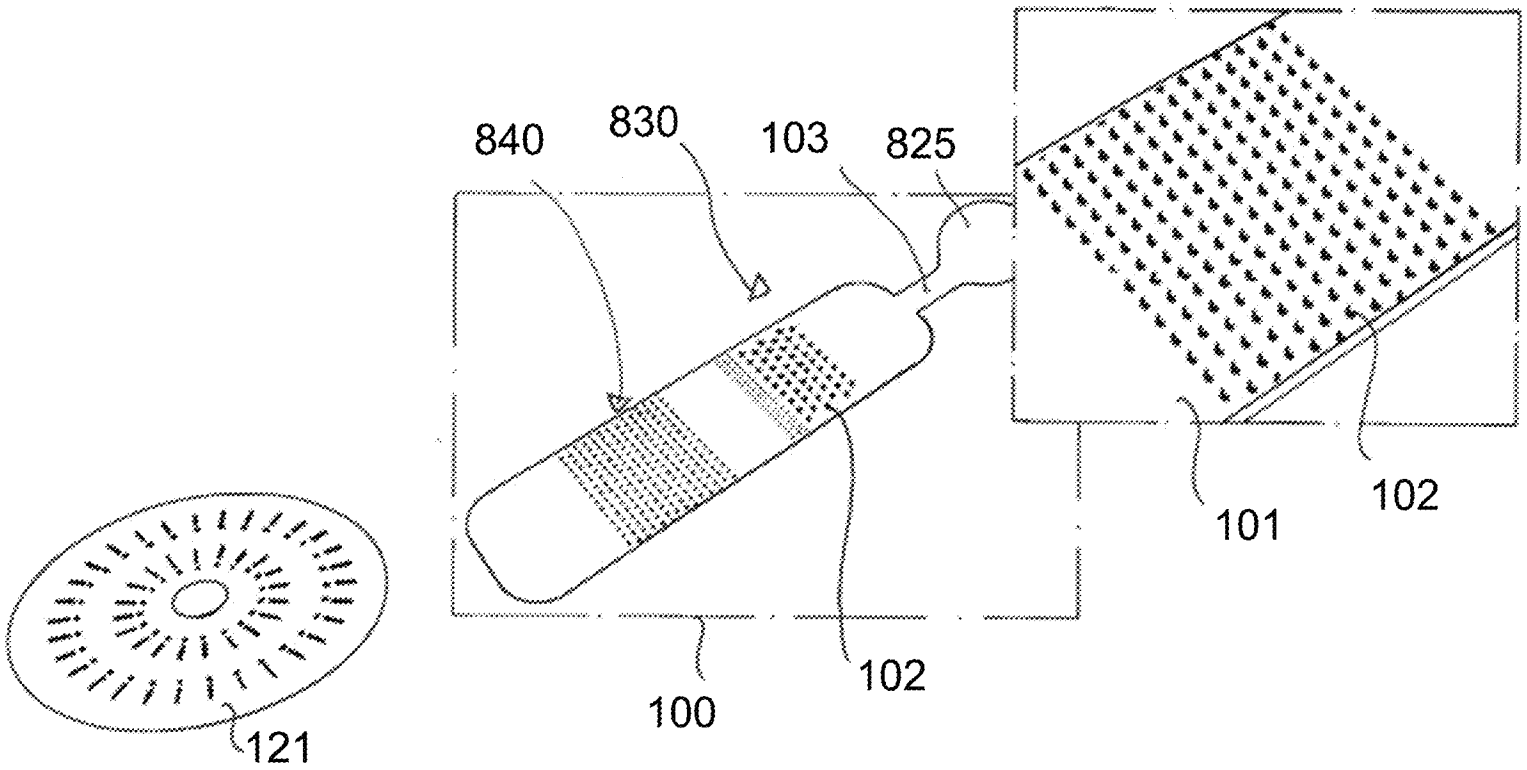
FIG. 8B shows in schematic form details of a disk having a capture chamber provided thereon, in accordance with the present teaching.

FIG. 8B shows more detail of the individual chambers arranged circumferentially about the disk 121. Each of the chambers will typically comprise an inlet 825 within which a fluid may be introduced. The fluid passes through an inlet region 103 into the main chamber potion 101 where the individual capture sites 102 are located. One or more capture regions 830, 840 may be provided within the chamber, each of the capture regions targeting specific particles. Desirably one is provided downstream of the other.

While the disk of FIGS. 8A and 8B represent an advantageous configuration for effecting rotating of a capture chamber in accordance with the present teaching other techniques such as modified test tubes ("Eppendorf tube"), cell culturing flasks, microscope slides or the like could be employed such that the rotation of the capture chamber may be effected using a standard centrifuge.

Figure 9A:
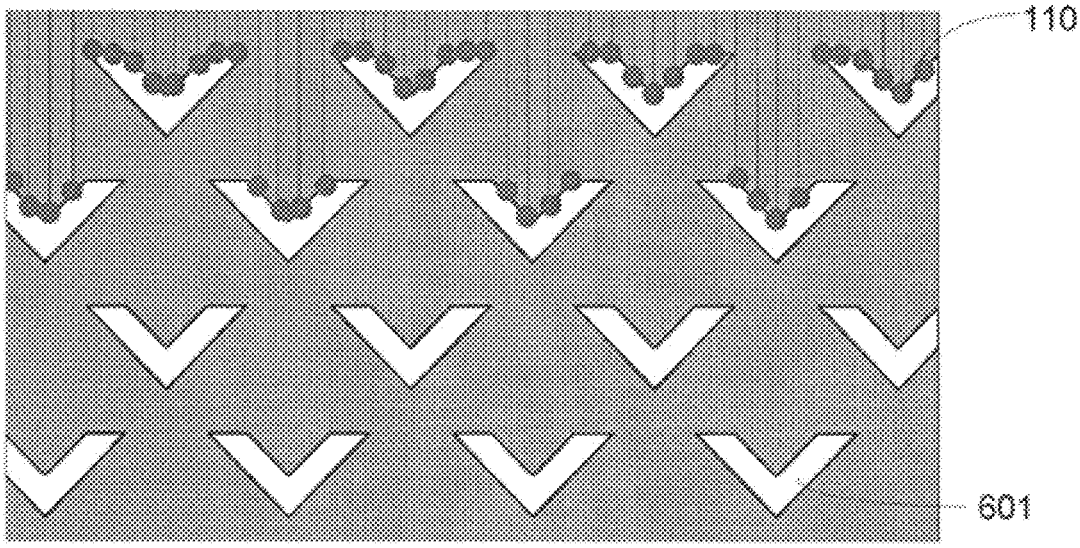
FIG. 9A is simulation of expected capture of particles in a stagnant flow capture environment in accordance with the present teaching.
Figure 9B:
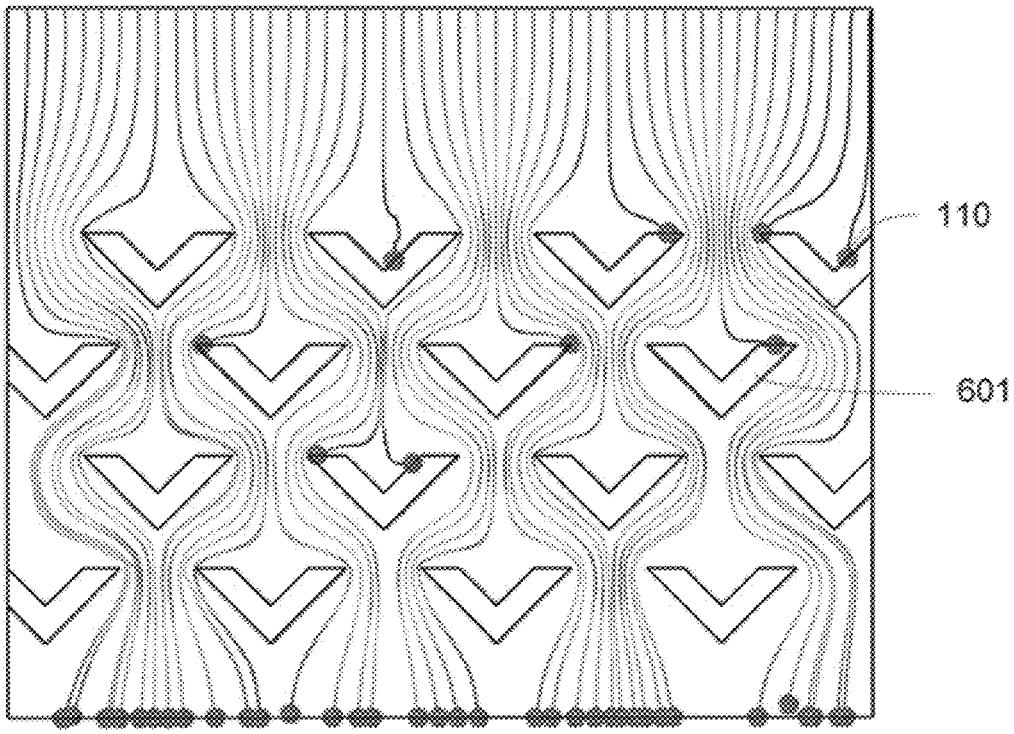
FIG. 9B is a simulation of results expected from a pressure driven environment.

FIGS. 9A and 9B show a comparison between the capture efficiencies of a pressure driven system (FIG. 9B) and one in accordance with the present teaching which is operable under stagnant conditions (FIG. 9A). In the pressure driven system, only approximately 20% of all particles are trapped, whereas the stagnant flow system in theory captures 100%.

It will be appreciated that a system in accordance with the present teaching may comprises a disk substrate with a plurality of capture sites arranged radially within a capture chamber. In contrast to pressure driven systems, the cells are sedimented under stagnant, i.e. stopped flow conditions into the retention structures. During their entire approach the cells thus follow straight (radial) paths, implying a 100% theoretical capture efficiency in an interlaced capture array, such as that shown in FIG. 9A. Furthermore, after being captured in the capture sites, the fixture of the cells or other particles is even reinforced by the centrifugal field.

Figure 10:
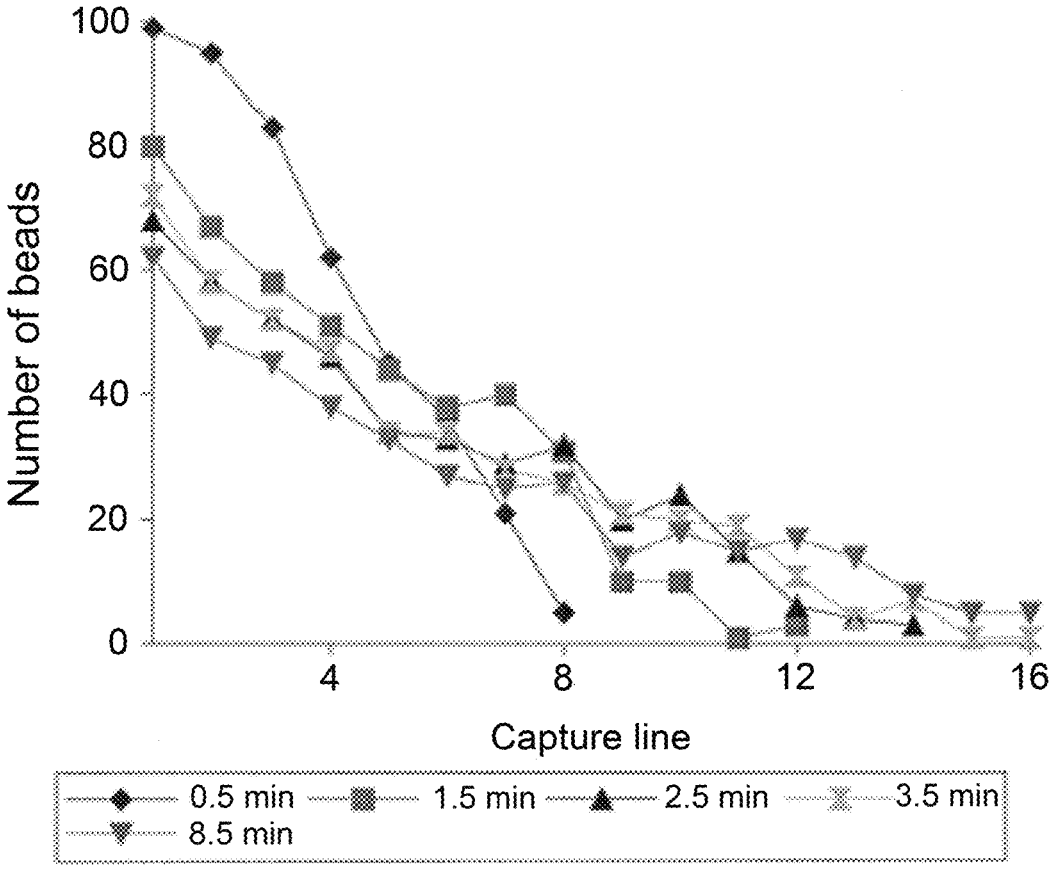
FIG. 10 shows in graphical population of beads in rows of capture sites for different times and dimensions in accordance with the present teaching.
Figure 11:
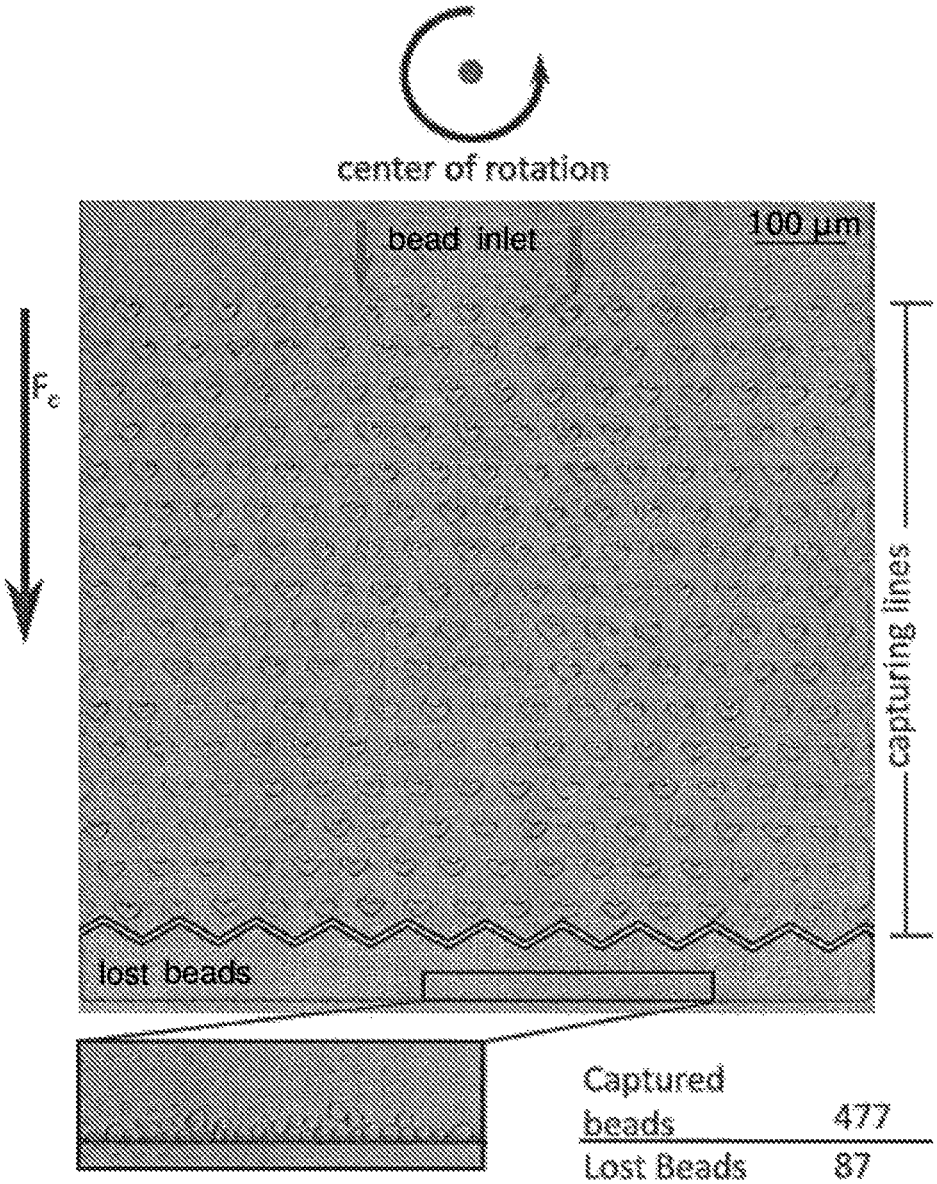
FIG. 11 is an image of a capture chamber with 16 rows of capture sites.
Figure 12A:
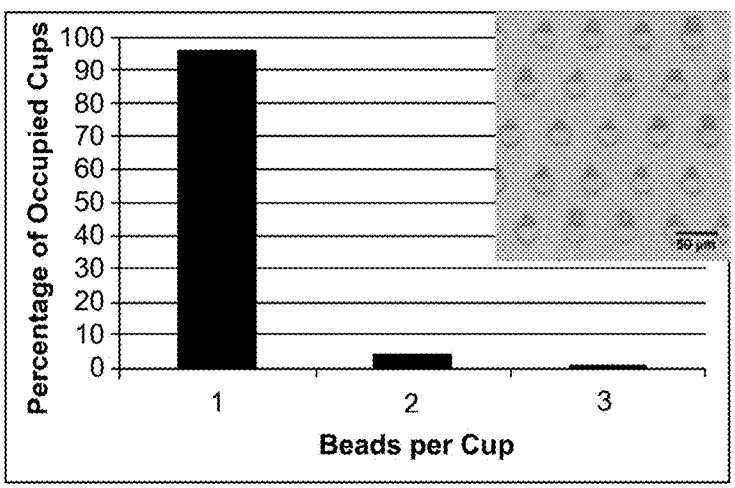
FIG. 12A shows in graphical form distribution of beads per capture site for a structure with a capture ratio Rc=1.5 (10-μm silica beads and a 15-μm capture area, 95.7% of all occupied capture sites are filled with only one bead.
Figure 12B:
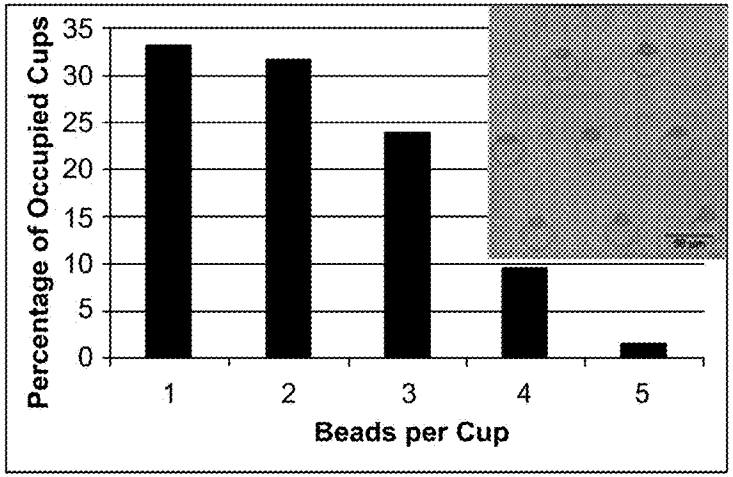
FIG. 12B shows in graphical form distribution of beads per capture site for a structure with a capture ratio Rc=2.5 82% of all filled capture sites contain between 1 and 3 beads.
Figure 12C:
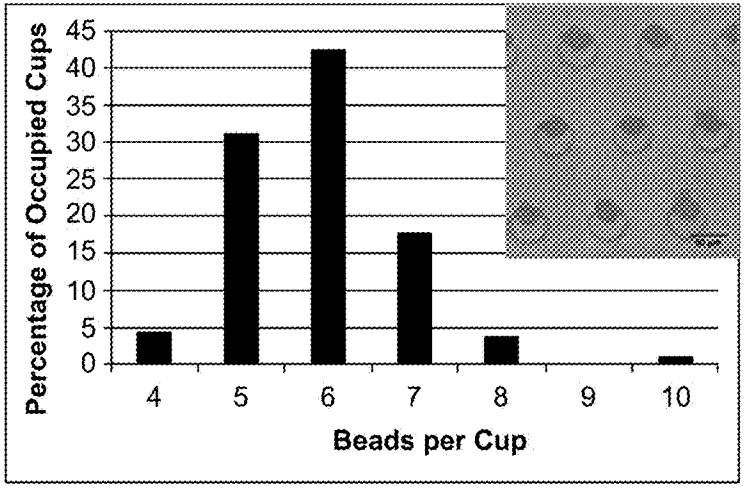
FIG. 12C shows in graphical form distribution of beads per capture site for a structure with a capture ratio Rc=3, 90% of all occupied capture sites contain 6±1 beads.
Figure 12D:
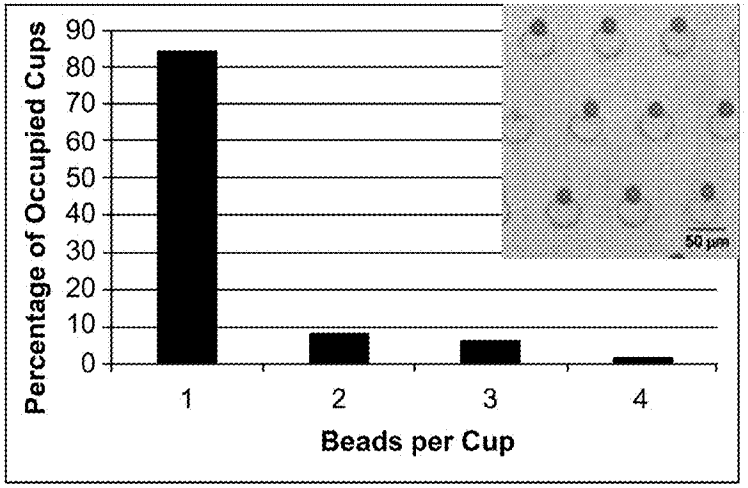
FIG. 12D shows in graphical form distribution of beads per capture site for a structure with a capture ratio Rc=1.25 and beads of 20 μm results in 84% single occupancy.

Experiments with 10-μm silica beads at a rotation frequency of 20 Hz have been performed with a characteristic size of the V-cups of 35 μm. Using a combination of SU-8 lithography and subsequent casting into PDMS it was possible to define individual capture sites within a capture chamber. By suitably dimensioning the individual capture sites, each capture site can only hold a certain, predefined maximum, number of beads and excess will beads propagate to the next capturing line within the array. The time dependent bead propagation through the capture lines is shown in the data in FIG. 10. Experiments confirmed the high capture efficiency of the system with measured capture efficiencies between 85% and 98% in less than 5 minutes (FIG. 11). It will be appreciated that this experimental evidence justifies the previous assertion that a system in accordance with the present teaching can provide an occupancy distribution peaking at single occupancy and/or with a capture efficiency close to the theoretical maximum.

Using the present teaching it is possible to provide a high level of control of the mean particle occupancy in arrays of scale-matched capture sites using centrifugal sedimentation. The induced centrifugal force may be combined ultrasound of other agitation of the particles. If the ultrasound is applied at the beginning of the capture regime through a sequence of intermittent bursts it is possible to reduce the mean particle distribution to a single occupancy and also to narrow the distribution width. By applying an ultrasound signal post capture, it is possible to allow for loosening of particle aggregates for a release of the trapped particles from the array. Once captured individual particles may be treated, stained and/or otherwise analyzed in situ while resting within the capture sites.

FIGS. 13 through 14 relate to experimental data resultant from such intermittent agitation of the capture chamber through ultrasonic agitation. As shown in FIGS. 13-13G, arrays of capture sites may be provided within a capture chamber the example shows a plurality of individual chambers each with a plurality of capture sites. In this exemplary arrangement the individual capture sites where provided with different cross-sections. Cross-sections of 15 μm, 25 μm and 30 μm were lithographically patterned and replicated in PDMS. To demonstrate the capture efficiency, 10-μm silica and 20-μm polystyrene beads were used. The capture chambers were provided on a disk substrate that was rotated at a spinning frequency of 15 Hz. The occupancy of the capture sites was recorded by visual inspection.

FIGS. 13A-13G show distribution of beads per capture site for structures with different capture ratios Rc. In particular, FIG. 13A illustrates data for Rc=1.5 (10-μm silica beads and a 15-μm capture area from which it is clear that 95.7% of all occupied cups are filled with only one bead. FIG. 13B shows a variant whereby the Rc=2.5. In this example 82% of all filled cups contain between 1 and 3 beads. FIG. 13C shows an example for Rc=3, in which 90% of all occupied cups contain 6±1 beads. FIG. 13D provides beads of 20 μm, and Rc=1.25 resulting in 84% single occupancy. In each of the four examples the ratio Rc=dc/dp of the active capturing cross section (dc) to the particle diameter (dp) was varied. For near scale matching, i.e., Rc between 1.25 and 1.5 in FIGS. 13A and 13D, almost all occupied capture sites (84% and 95%, respectively) feature a single occupancy. The mean occupancy of each capture site increases with the retention capacity of the capture sites and thus Rc (FIGS. 13B and 13C). For example, at Rc=3, almost all occupied capture sites hold between 5 and 7 beads (90%).

The sequence of images provided in FIG. 14 demonstrates that the captured beads can be retrieved through a sequence of centrifugal sedimentation and interspersed ultrasonic treatment. It will be understood that ultrasonic agitation is one example of an agitation process. Using such an agitation process optimally may be used to agitate particles post their initial occupancy in one or more capture sites so as to facilitate a discharge of already captured particles to sequentially occupy chambers radially away from the proximal portion of the capture chamber.

Figures 14A, 14B:
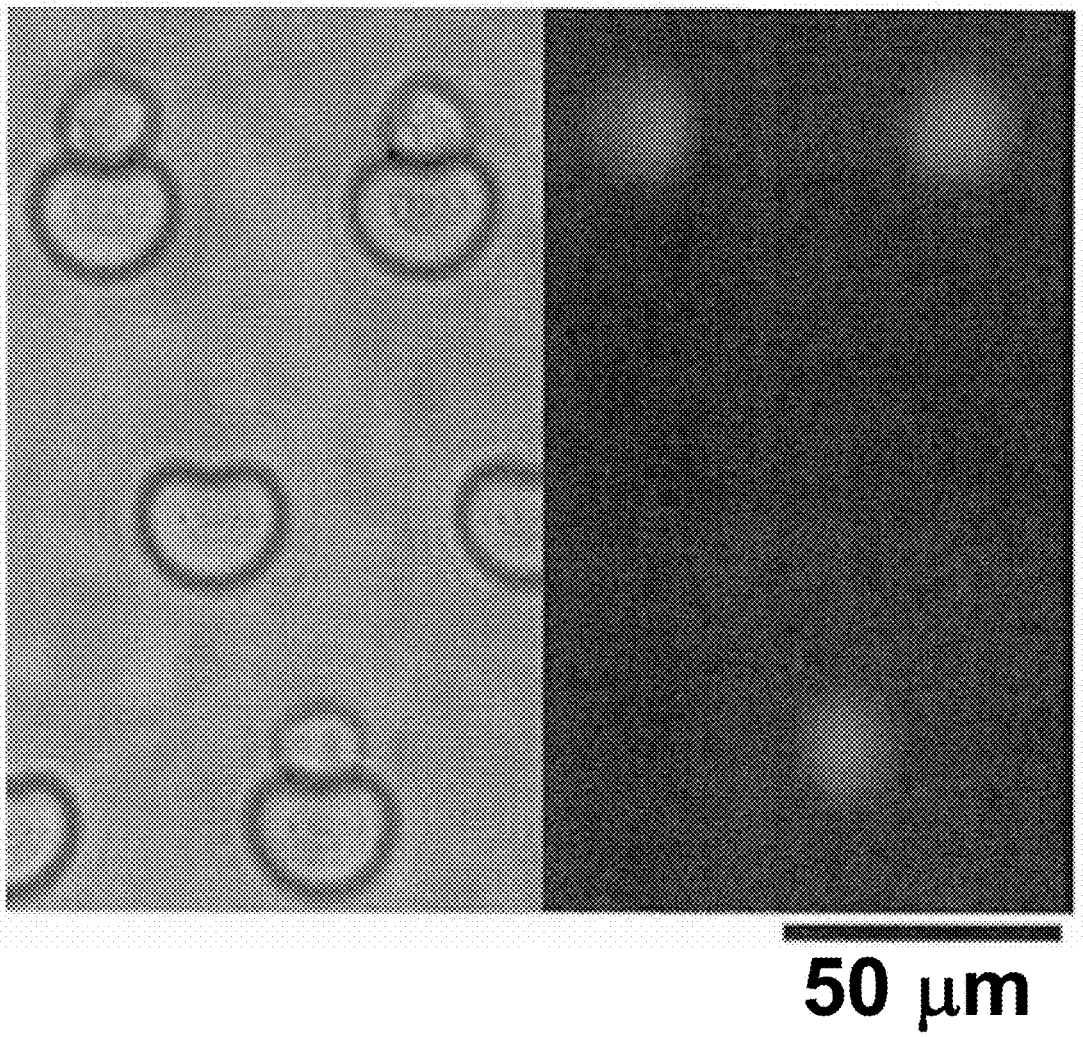
FIGS. 14A and 14B show images of captured HeLa cells with the left hand side image (FIG. 14A) showing a bright field image and the right hand side image (FIG. 14B) showing a fluorescence image after staining with Propidium Iodide.

Once captured, the individual particles may be treated or otherwise analyzed. This ability to distribute, treat and eventually retrieve an ensemble of particles is of particular interest to systems biology. To demonstrate this, FIGS. 14A and 14B show captured HeLa cells in 15-μm capture sites. Once captured (the Left hand side image, FIG. 14A) it was then possible to subsequently fix the captured cells, followed by staining with PI (Propidium iodide). The right hand side image (FIG. 14B) is a fluorescent image resultant from excitation of a stained cell within a capture site. To facilitate this luminescence it is desirable that the materials used in the fabrication of the capture chamber and sites is at least partially transparent to excitation light to allow for in-situ analysis of captured particles through an optical assay. This sequential flow of a plurality of fluids may be optimally effected using a valving structure that allows the volume of fluid within the chamber to be maintained at a fixed or static level during a rotation of the chamber.

It will be appreciated that heretofore has been described exemplary arrangement of particle capture system that can be used in the context of a lab-on-a-chip platform for particle- and cell-based assays. By varying the ratio between the sizes of particles to be captured and the dimensions of the capture sites selected for that capture, it is possible to impact the mean value as well as the width of the occupancy distribution. In this way by choosing appropriate operational parameters (e.g. size, geometry and spacing of capture sites, centrifugal frequency, overall number of particles applied, concentration of particles applied, (interspersed) agitation), the capture efficiency may be modified. For example it is possible to shape the captured particle distribution and shift its peak, even so far that it goes to 0, i.e. that all initially centrifugally captured beads may be retrieved.

By alternating periods of sedimentation and agitation through for example exposure to ultrasound, a strong bias towards single occupancy could be induced, the distribution width could be narrowed and the particles could eventually be retrieved from the array. In addition, cells could be captured, treated and stained, allowing study of individual or defined numbers of cells aligned in an array in systems biology. While exemplary geometrical configurations and methodologies have been described it will be appreciated that modifications can be made to that hereinbefore described without departing from the teaching of the present disclosure.

The capture chamber described herein is desirably a microfabricated or microengineered chamber with the capture areas having dimensions that are scale matched with the particles being captured. Within the present specification, the term microengineered or microengineering or microfabricated or microfabrication is intended to define the fabrication of three dimensional structures and devices with dimensions in the order of millimeters or a sub-millimeter scale.

The various embodiments described above can be combined to provide further embodiments. All of the commonly assigned US patent application publications, US patent applications, foreign patents, foreign patent applications and non-patent publications referred to in this specification and/or listed in the Application Data Sheet, including but not limited to U.S. patent application Ser. No. 12/855,579, filed Aug. 12, 2010 are incorporated herein by reference, in their entirety.

The words comprises/comprising when used in this specification are to specify the presence of stated features, integers, steps or components but does not preclude the presence or addition of one or more other features, integers, steps, components or groups thereof.

The invention claimed is:

1. A centrifugal capture chamber defined in a substrate and comprising an inlet to receive a fluid, the fluid comprising micron-sized particles of interest, the capture chamber being operably rotatable about an axis of rotation and having an axis of rotation proximal portion and an axis of rotation distal portion, the capture chamber comprising:

an array of individual rows of a plurality of capture sites, each capture site comprising side walls extending towards the axis of rotation proximal portion and defining a capture area that is open towards the axis of rotation proximal portion, and each capture site having dimensions scale-matched with dimensions of the micron-sized particles of interest to be captured while travelling within the capture chamber from the axis of rotation proximal portion to the axis of rotation distal portion, wherein a first row of the array is located at a first defined distance from the axis of rotation and a second row of the array is located at a second defined distance from the axis of rotation, the second defined distance being greater than the first defined distance, the individual rows being staggered relative to other ones of the individual rows such that there is no direct, collision-free path in a straight line through the array from the axis of rotation proximal portion to the axis of rotation distal portion and particles travelling under the influence of the centrifugal force will encounter at least one of the capture sites in a respective path of travel of the particle; and wherein rotation of the substrate provides a centrifugal force which induces motion on the particles within the chamber such that the particles are biased in straight lines in a radial direction away from the axis of rotation of the chamber and are sedimented into the capture areas of the capture sites and wherein a distance between individual ones of the capture sites on any one row of the array is greater than dimensions of the capture areas for those capture sites such that operably particles of interest having dimensions larger than the capture area of the capture sites in the first row are biased into the second row.

2. The chamber of claim 1 wherein the chamber is microfabricated.

3. The chamber of claim 1 wherein the particles comprise cellular matter.

4. The chamber of claim 1 wherein the plurality of capture sites are distributed throughout the chamber.

5. The chamber of claim 1 wherein individual capture sites are dimensioned to retain not more than one particle of interest.

6. The chamber of claim 1 wherein each of the capture sites are dimensioned for single occupancy.

7. The chamber of claim 1 wherein the capture sites are configured as one or more of:

a) V-shaped capture sites, b) cup-shaped capture sites;

c) a collar or torc shaped capture sites.

8. The chamber of claim 1 wherein the chamber comprises a base, side walls and a roof.

9. The chamber of claim 8 wherein a height of individual ones of the capture sites is less than a height of the side walls such that a gap is defined between a top of the capture sites and the roof of the chamber.

10. The chamber of claim 8, further comprising baffles or guides to preferentially direct particles away from the side walls.

11. The chamber of claim 1 wherein the plurality of capture sites collectively define a sieve through which a fluid may flow from the axis of rotation proximal portion to the axis of rotation distal portion.

12. The chamber of claim 1, further comprising a valve element to control the introduction of a fluid into the chamber.

13. The chamber of claim 12 wherein the valve element is a frequency-controlled valve.

14. The chamber of claim 12 wherein the valve element is a siphon primed by capillary action or overflow.

15. The chamber of claim 1 comprising an outlet for allowing egress of fluid from the chamber.

16. The chamber of claim 15 wherein the outlet is provided with a valve to allow the controlled egress of fluid from the chamber.

17. A system for sedimentary centrifugal capture of particles, the system comprising a rotatable substrate having at least one capture chamber, the capture chamber being rotatable about an axis of rotation of the substrate, the chamber having an axis of rotation proximal portion and an axis of rotation distal portion, the capture chamber comprising an inlet to receive a fluid comprising micron-sized particles of interest, the capture chamber comprising:

an array of individual rows of a plurality of capture sites, a first row at a first defined distance from the axis of rotation and a second row at a second defined distance from the axis of rotation, the second distance greater than the first distance, individual rows staggered relative to other individual rows such that there is no direct path in a straight line from the axis of rotation proximal portion to the axis of rotation distal portion and particles travelling under the influence of the centrifugal force will encounter at least one capture site during in a respective path of travel of the particle;

the capture sites defining a capture area for receipt of individual particles travelling within the capture chamber from the axis of rotation proximal portion to the axis of rotation distal portion, the capture area being scale-matched with at least one dimension of the particles to be captured;

each capture site comprising side walls extending towards the axis of rotation proximal portion and defining a capture area that is open towards the axis of rotation proximal portion; and wherein rotation of the substrate provides a centrifugal force which induces motion on the particles within the chamber such that they are biased in straight lines in a radial direction away from the axis of rotation and are sedimented into the capture areas of the capture sites and wherein a distance between individual ones of the capture sites on any one row is greater than respective dimensions of the capture areas for those capture sites such that operably particles of interest having dimensions larger than the capture area of capture sites in the first row are biased into the second row.

18. The system of claim 17, further comprising a drive element for effecting a rotation of the rotatable substrate.

19. The system of claim 18 comprising a spindle, the substrate being dimensioned to being receivable onto the spindle, receipt of the substrate on the spindle coupling the substrate to the drive means.

20. The system of claim 18 wherein the drive element effects rotation of the substrate at frequencies in the range of 10 to 100 Hz.

21. The system of claim 20 wherein the drive element effects rotation of the substrate at 20 Hz.

22. The system of claim 20 wherein the drive element provides a first frequency for effecting capture of particles in capture sites and a second frequency for effecting a discharge of particles from capture sites.

23. The system of claim 17 comprising an agitator for selectively agitating particles within the chamber.

24. The system of claim 23 wherein the agitator agitates particles to effect their discharge from capture sites.

25. The system of claim 17 wherein one of the size, geometry and spacing of capture sites is determined with reference to the particles with which the system is operably used.

26. The system of claim 17 wherein the substrate is at least partially optically transparent to allow an optical analysis of captured particles.

* * * * *